United States Patent [19]

Clark

[11] Patent Number: 4,488,725

[45] Date of Patent: Dec. 18, 1984

[54] FLIP CUBE PUZZLE

[76] Inventor: William H. Clark, 7731 W. Lake Dr., Lake Clarke Shores, Fla. 33406

[21] Appl. No.: 521,588

[22] Filed: Aug. 9, 1983

Related U.S. Application Data

[63] Continuation-in-part of Ser. No. 384,550, Jun. 3, 1982, abandoned.

[51] Int. Cl.[3] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 416,344 | 12/1899 | Rice | 273/153 S |
| 1,251,400 | 12/1917 | Mees | 273/153 S |
| 1,518,889 | 12/1924 | Wooster | 273/153 S |
| 3,845,959 | 11/1974 | Kosarek | 273/153 S |
| 4,036,503 | 7/1977 | Golick | 273/153 S |

*Primary Examiner*—Anton O. Oechsle

*Attorney, Agent, or Firm*—Louis E. Hay

[57] ABSTRACT

A manipulative cube puzzle having a hollow box structure of parallelepipedon form and containing a predetermined number of cubes at least one less than the capacity of said box structure in at least one tier, the construction of said box structure being such that any cube therein may be slidably positioned for flipping to any one of 24 positions at the option and control of the player.

12 Claims, 18 Drawing Figures

FLIP CUBE PUZZLE

This is a continuation in part application of co-pending application Ser. No. 384,550 filed June 3, 1982, abandoned.

REFERENCE TO RELATED U.S. PATENT

Ser. No. 366,363 Cube Puzzle—Clark—filed Apr. 7, 1982.

BACKGROUND OF THE INVENTION

Puzzles or games in which a rectangular box or container is divisible into a given number of spaces, and filled with one less cube than the number which would be required to fill the container, are old to the art. The space, which is not occupied by a cube, thus provides a space into which an adjacent cube may be slid, which in turn creates a space having a different location in the container. Initially, the cubes are placed at random, or jumbled; and the object of the game is to manipulate the cubes to a position which will spell words, or to arrange the cubes in a numerical sequence. Most of these puzzles have been single tier puzzles, as for example, the puzzles taught in U.S. Pat. No. 1,274,294 Lobl and in U.S. Pat. No. 1,464,424 Hartman.

U.S. Pat. No. 1,518,889 Wooster, is an example of a two tier puzzle in which the faces of the individual cubes are printed or impressed with letters and numerals. The cubes must be arranged in such a manner that it is possible to spell certain words and make certain numerical arrangements. Since the cubes cannot be rotated in the container, such a puzzle is limited to a very few possible words and numerical arrangements. The cubes cannot be jumbled in the container at random because the cubes cannot be tumbled from one face to an adjacent face.

U.S. Pat. No. 4,036,503 Golick is an example of a more recent cube puzzle in which the cubes may be rotated, as well as slid from an occupied space into an adjacent space. The Golick teachings relate to a puzzle in which the cubes are slid or rotated within the container by manipulating the container itself, such as by rotating, tilting, twisting or tapping on the container. One feature stressed by Golick is that regardless of the skill developed by a player, there will always be an element of chance as to which of his cubes will change position or attitude. A distinguishing feature of Golick is that a player will never actually be in full command of the cubes and will never be able to directly manipulate the cubes.

SUMMARY OF THE INVENTION

A cube puzzle in accordance with the present invention may have one or more tiers of cubes, each tier having space for at least four cubes. A predetermined number of cubes, at least one less than the capacity of the container, are used in the puzzle. A cube may be slid into an adjacent vacant space in the manner of prior cube puzzles. In addition to sliding, a selected cube in the upper tier may be rotated or flipped to an adjacent face thereon about both the horizontal and vertical axes, and without changing the attitude of the puzzle. A selected cube may be oriented to any one of 24 positions while remaining in its initial space within the container. There are several species of the present cube puzzle which will be readily understood from the drawings and the description to follow.

DESCRIPTION OF THE PREFERRED EMBODIMENT

Figure 1:
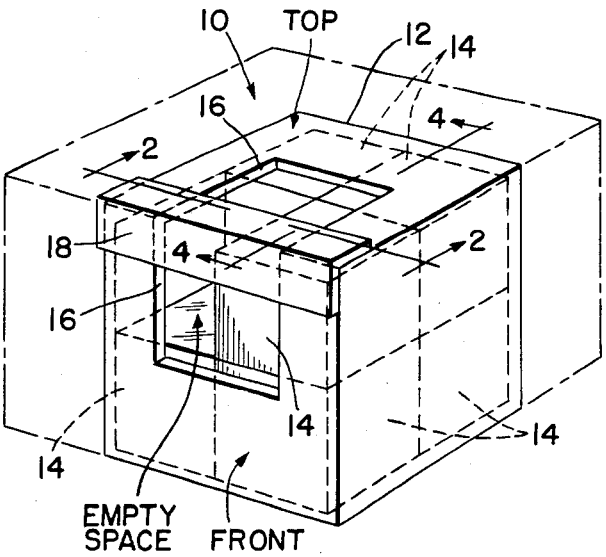
FIG. 1 is a perspective of a first species of the cube puzzle, with the solid lines depicting a seven cube puzzle, and with the phantom lines indicating that the puzzle may be expanded.
Figure 7:
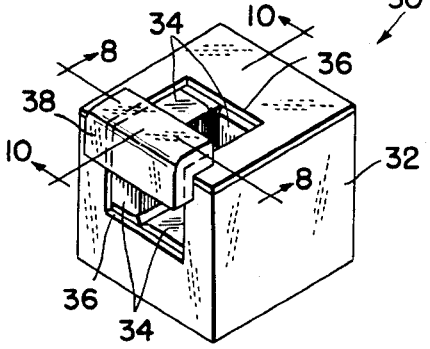
FIG. 7 is a perspective of a second species of the cube puzzle comparable to the perspective of the first species depicted in FIG. 1.

For purposes of the present invention, the box structure which houses the cubes is defined as being of parallelepipedon form and oriented to the attitude depicted in FIG. 1 and FIG. 7 of the drawings. The box structure is further defined as having a vertical front side, a vertical back side, two vertical lateral sides, a horizontal top side, and a horizontal bottom side. The interior of the box structure is defined as having a substantially rectangular interior.

Specific reference is made to FIG. 1 which depicts a first species of the present puzzle 10 as having a hollow container or box structure having a rectangular interior for housing or containing in slidable relationship a predetermined number of uniformly sized cubes 14 in one or more horizontal and vertical tiers. The number of cubes is preferably one less than the capacity of the box structure 12; however, fewer cubes may be used within the scope of the invention. The puzzle depicted by the solid lines of FIG. 1 contains seven cubes housed in a box structure having a capacity for eight cubes.

One novel functional distinction of the present invention over the puzzles of the referenced U.S. patent and U.S. Pat. No. 4,036,503 Golick is the manner in which a cube is rotated from one face to an adjacent face thereon. In the designs of the referenced patent and U.S. Pat. No. 4,036,503 a cube is tripped or tumbled from an occupied space into an adjacent unoccupied or vacant space, usually by changing the attitude of the puzzle. In the puzzle of the present invention, a cube is rotated or flipped from one face to an adjacent face thereon without changing the space location of the cube in the box structure.

Another novel functional distinction of the puzzle constituting the present invention is that a selected cube may be rotated or flipped on both a vertical and/or horizontal axis of rotation without changing the attitude of the puzzle and without reliance on the force of gravity to produce the rotation. Whereas the U.S. Pat. No. 4,036,503 teachings rely on gravity to rotate a cube, and also involve elements of chance, the cubes in the present puzzle are under full control of the player at all times, and without elements of chance. In the present puzzle, the player uses a finger tip to apply the necessary force in much the same manner as picking a string on a stringed musical instrument.

Figure 2:
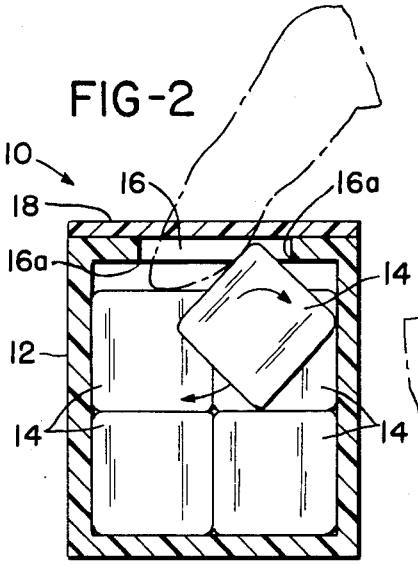
FIG. 2 is a vertical section taken on line 2—2 of FIG. 1 and depicting a player's finger tip initiating the flipping of a cube.

The interior lateral dimension of the box structure, as viewed in FIG. 2, is such as will provide a freely sliding fit of the cubes. As clearly depicted in FIG. 2, the interior vertical dimension of the box structure must be increased by an amount sufficient to permit rotation of a cube. A comparable increase must also be provided for the interior longitudinal dimension of the box structure as depicted in FIG. 4.

Figure 3:
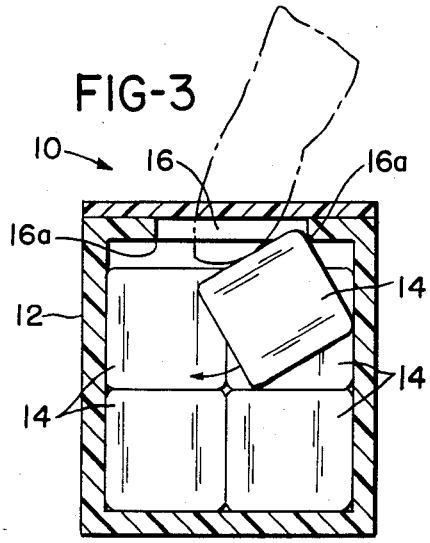
FIG. 3 is a vertical section comparable to FIG. 2 and depicting a cube contacting the pivot edge about which the cube continues its rotation about a horizontal axis.
Figure 4:
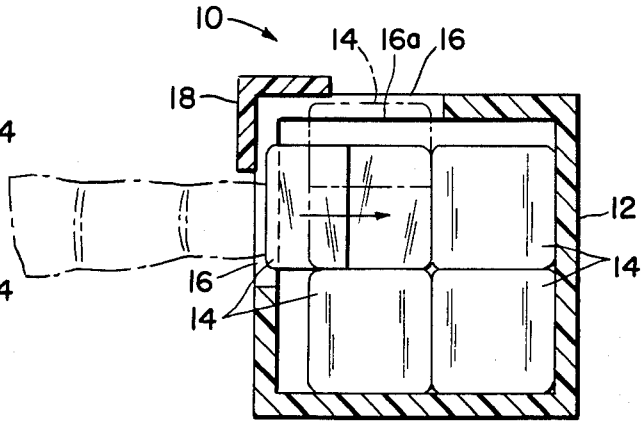
FIG. 4 is a vertical section taken on line 4—4 of FIG. 1 and depicting a cube being flipped on a vertical axis.

The front and top side of the box structure are provided with apertures 16 through which a player may insert a finger tip and flip a cube as depicted in FIGS. 2–4. The preferred shape of the apertures is rectangular, as depicted, and they may be continuous apertures in the top and front side of the box structure, in which case a corner barrier strip 18 should be provided as best illustrated in FIG. 1 and FIG. 4.

The specific lateral dimension of the apertures 16 will, to a large degree be dependent on the size of the cubes. In a puzzle having space for two cubes in any one direction as depicted by the solid lines in FIG. 1, the apertures should be equally spaced laterally between the two cubes, and the lateral width of the apertures must be sufficient to permit entry of the player's finger tip into the vacant space adjacent to the cube which is to be flipped. In nearly all cases the lateral opening will be greater than the width of a cube, for which reason the angle barrier strip 18 is used to prevent escape of the cubes. The longitudinal dimension of the apertures should be slightly greater than the width of a cube to prevent interference with the cube to be flipped. In a puzzle having space for four cubes in each tier, the cube to be flipped may be flipped in either direction.

When using a barrier strip 18, and as illustrated in FIG. 2, for example, the space required to flip a cube is preferably established between the top of the cubes in the next lower tier and the inside surface of the barrier strip. The purpose for this will be explained below.

There are several methods for fabricating the box structure 12. One method would be to form the top, bottom, and the four sides from clear plastic sheets as individual pieces, and to then assemble them with suitable adhesive. The box structure may then be loaded with the cubes through the apertures 16, after which the barrier strip 18 may be attached with adhesive.

Another method for forming the box structure would be to injection mold the top and four sides as a unit, and to then attach the bottom with adhesive after first loading the cubes. The apertures would be formed by core elements in the injection mold, and it would be convenient to form the barrier strip to be flush with the top and front side of the box structure.

Figure 5:
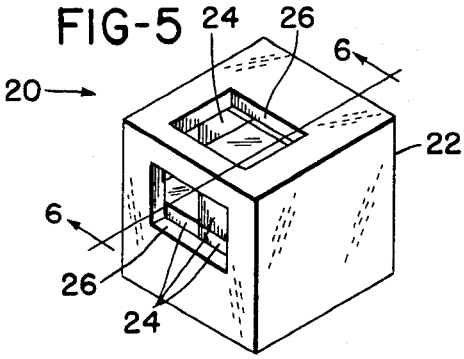
FIG. 5 is a reduced scale perspective depicting a variation of the hollow container or box structure depicted in FIG. 1.

Specific reference is made to FIG. 5 which depicts a puzzle in which the box structure is made by the injection molding process with the barrier strip flush with the top and front side of the box structure. The cube puzzle 20 has a hollow container or box structure 22 of a size and general configuration which is comparable with the box structure 12 which was previously described, and which for purposes of description also contains seven cubes 24 in a box structure having space for four cubes in each of two tiers as best illustrated in FIG. 1. Cube puzzle 20 is provided with apertures 26 functionally comparable to the previously described apertures 16. The portion of the box structure 12 which was provided with the barrier strip 18 is made integral in the box structure 22 as depicted in FIG. 5, which results in a box structure in which all six sides of the parallelepipedon have smooth external surfaces.

Specific reference is now made to FIGS. 2 and 4 which depict the motion of the cube being flipped at its mid-position of rotation, in which the cube is rotated 45 degrees from its original position. The vertical distance between the top face of the cubes in the lower tier and the bottom surface of the barrier strip 18 must be sufficient to provide clearance for the cube when the diagonal corners on a face of the cube are in the vertical position depicted.

FIG. 3 depicts further rotation of the cube being flipped to a position at which a face of the cube comes into contact with a lower edge 16*a* of aperture 16. The particular advantage of this position relationship is that the corner edge 16*a* acts as a pivot edge about which the cube rotates and accelerates the final flipping action of the cube. As soon as the bottom edge of the cube swings to the left a relatively small amount, the upper portion of the cube will disengage from the edge of the aperture, which acted as the pivot edge, in much the same manner as a sear in a gun disengages, and the cube snaps to its new position.

As depicted in FIG. 4, the same internal distance for flipping a cube through the aperture 16 in the front side of the box structure 12 must be provided, as is provided and described for flipping a cube through the aperture in the top of the box structure. The solid outline of the cube in FIG. 4 depicts the position of the cube at 45 degrees rotation when being flipped through the aperture in the front side of the box structure. The phantom outline of the cube in FIG. 4 depicts the position of a cube at 45 degrees or rotation when being flipped through the aperture in the top side of the box structure. A cube may be flipped either on the X—X or the Y—Y axis of the puzzle without changing the attitude of the puzzle from that depicted in FIG. 1.

Figure 6:
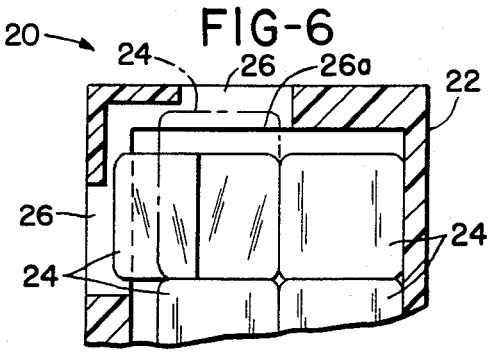
FIG. 6 is an enlarged vertical section taken on line 6—6 of FIG. 5.

Specific reference is now made to FIG. 6 which depicts a cube being flipped in a puzzle having a barrier strip which does not extend from the outer faces of the box structure, as depicted in FIG. 5. Such a barrier strip is clearly illustrated in FIG. 6, and is formed by extending the thickness of the front and top side of the box structure to be flush with the outside surfaces of the barrier strip 18 which was illustrated in FIG. 4. The phantom outline of cube 24 in FIG. 6 is comparable with the phantom outline of cube 14 in FIG. 4. A comparison of the internal dimensional relationship between cubes and internal structure in FIG. 4 and FIG. 6 clearly shows them to be identical.

The faces or sides of the cubes may be embossed or imprinted in various colors, with numerals, or with abstract symbols which are to be aligned in various ways as the solutions to problems and arrangements in which the cubes are to be aligned in relationship with each other.

The phantom lines in FIG. 1 are indicative of all the species of the present invention, and are to indicate that the basic cube puzzles may be expanded from the seven cube puzzle which has been described. The expansion may be to increase the number of tiers, or to increase the number of cubes in each tier, or to increase both the number of tiers and the number of cubes in each tier. An expanded puzzle may have more than a single pair of apertures as shown in the basic seven cube puzzle.

A puzzle in accordance with the present invention may also be made with a single horizontal tier of cubes. The minimum number of cubes would be three cubes in a box structure having a capacity for housing four cubes. A greater number of cubes would be preferable, as for example, seven cubes in a box structure having a capacity for housing eight cubes.

A second species of the present invention is depicted in FIGS. 7–12. The principal distinctions become apparent when comparing FIGS. 9–10 with FIGS. 3 and 4.

In the first species, when the cube is flipped and is at its midpoint of rotation, as in FIG. 2, the uppermost corner of the cube does not extend to be outside the top surface of the box structure or container 12 since it is restrained by the barrier strip 18. In the second species, when the cube being flipped is at its midpoint of rotation, as in FIG. 9, the uppermost corner of the cube extends to be outside the top surface of the box structure 32, and extends into an alcove 38. When using the same size cubes in both FIG. 2 and FIG. 9, the internal vertical dimension of the box structure 32, as in FIG. 9, will be less than the corresponding internal vertical dimension of box structure 12, as in FIG. 2. The alcove provides the additional space in the second species which is required for the cube to flip.

The second species, or cube puzzle 30 consists of a hollow container or box structure 32 having a rectangular interior for housing or containing in slidable relationship a predetermined number of uniformly sized cubes 34 in one or more horizontal and vertical tiers. The number of cubes is preferably one less than the capacity of the box structure; however, fewer cubes may be used within the scope of the invention. The puzzle depicted in FIGS. 7–10 contains seven cubes in a box structure having a capacity for four cubes in each of two horizontal tiers.

Figure 8:
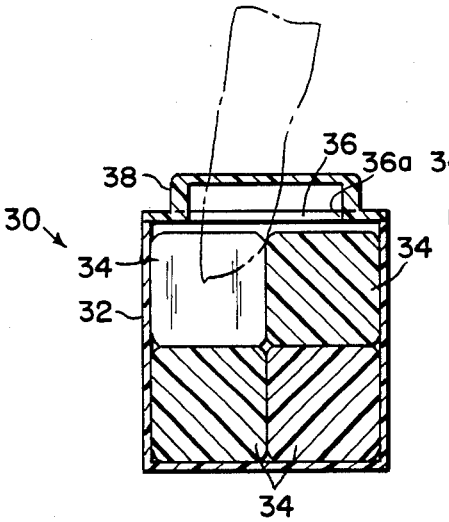
FIG. 8 is a vertical section taken on line 8—8 of FIG. 7 and depicting a player's finger tip initiating the flipping of a cube.
Figure 9:
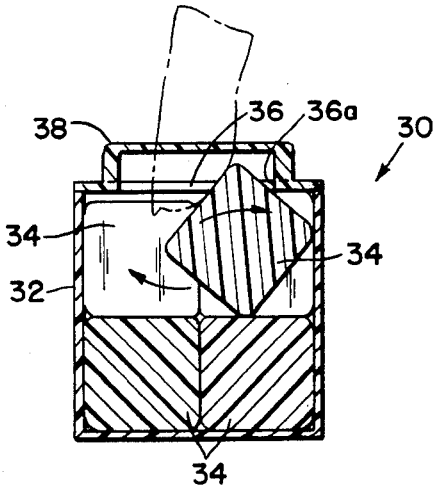
FIG. 9 is a vertical section comparable to FIGS. 8 and 8A and depicting the cube, being flipped, in contact with the pivot edge of the aperture in the container about which edge the cube continues its rotation about a horizontal axis.
Figure 10:
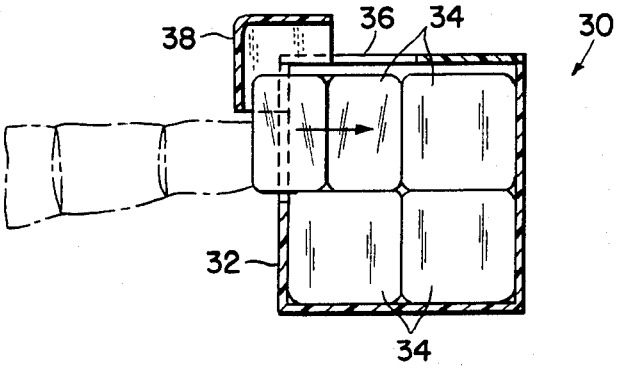
FIG. 10 is a vertical section taken on line 10—10 of FIG. 7 and depicting a cube being flipped on a vertical axis.

The top and front side of the box structure are provided with apertures 36 through which a player may insert a finger tip and flip a cube as depicted in FIGS. 8–10. The preferred shape of the apertures is rectangular, as depicted, and they may be continuous apertures in register at the top and front of the box structure. The dimensions of the apertures and their location in the box structure should be comparable with, and for the purpose previously described for the first species.

The intersecting area between the apertures in the front and top of the box structure is provided with an alcove 38 which extends from the front and top of the box structure a sufficient distance to provide clearance for a cube at the midpoint of its rotation when being flipped about a horizontal axis as depicted in FIG. 9, and about a vertical axis as depicted in FIG. 10.

Figure 11:
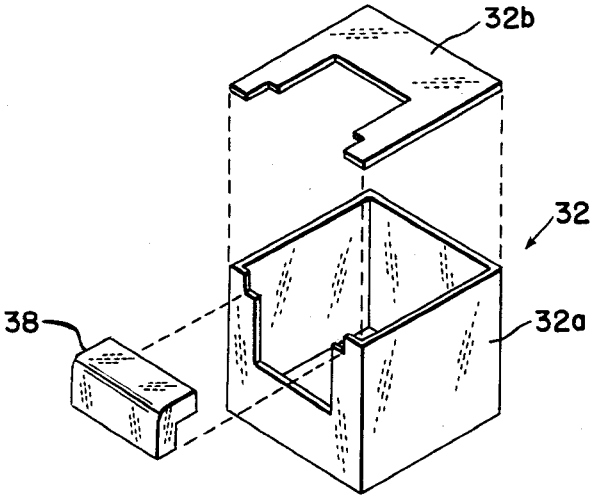
FIG. 11 is an exploded perspective depicting one method for constructing the container for housing the cubes.
Figure 12:
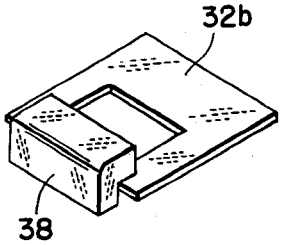
FIG. 12 is a perspective depicting two elements of FIG. 11 injection molded as a single part.

One method of constructing the container 32 is depicted in the exploded perspective FIG. 11. The elements of the container may be made of a plastic material by the well known injection molding process. The container may be made with a box section 32*a* containing the aperture in the front of the box, a top section 32*b* containing the aperture in the top of the box, and an alcove section 38. The three sections may be held in assembled position by use of a suitable adhesive, or by heat bonding. Other construction methods may be used; as for example, the alcove section 38 may be molded integral with the top section 32*b* as depicted in FIG. 12.

In both species of the puzzle, a cube may be slid into any adjacent vacant space in the usual manner, including the sliding between adjacent tiers.

The movement novelty of the present puzzle is that a cube may be rotated or flipped to any desired position without changing its space location in the box structure.

Figure 8A:
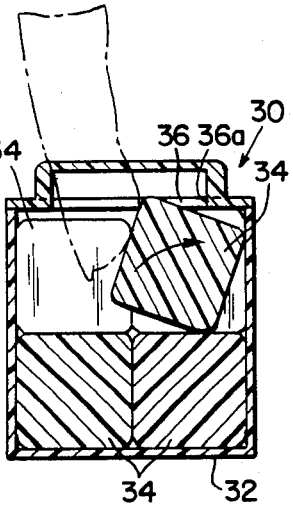
FIG. 8A is a vertical section comparable to the section shown in FIG. 8 and depicting the cube being flipped in an intermediate position.

FIG. 8 depicts the finger tip of a player inserted into the vacant space adjacent to the cube to be flipped. Lateral pressure is applied to the adjacent top edge of the cube which commences to rotate as depicted in FIG. 8A. The top edge of the cube, which is parallel to the edge contacted by the finger tip, slides downwardly against the vertical lateral wall of the box structure, while the adjacent bottom edge of the rotating cube slides laterally in relationship with the stationary cube directly below the rotating cube. The sliding motion of the rotating cube continues until it contacts the edge 36*a* of the aperture depicted in FIG. 9. The edge 36*a* becomes a pivot about which the cube is flipped; the cube coming to rest at an attitude 90 degrees from its position before being flipped. The described sequence occurs as a rapid and continuous movement with no awareness of the initial sliding movement. Both species of the puzzle flip a cube in the described manner. Both species permit the flipping of a cube about either the horizontal or the vertical axis without changing the attitude of the puzzle from that depicted in the drawings.

Figure 13:
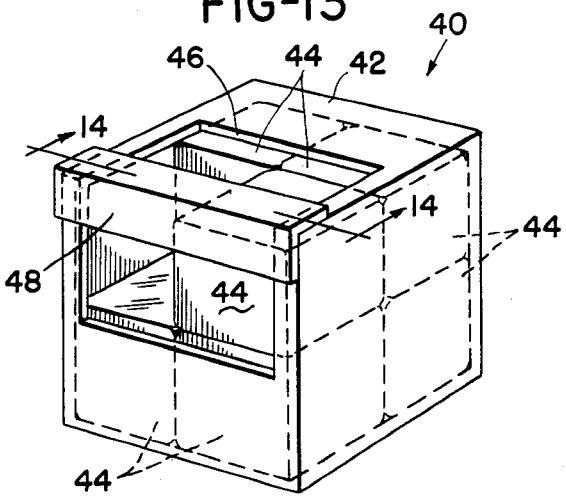
FIG. 13 is a perspective depicting a variation of the puzzle depicted in FIG. 1.
Figure 14:
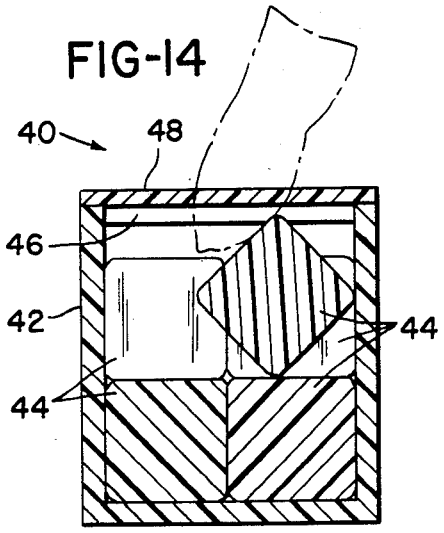
FIG. 14 is a vertical section taken on line 14—14 of FIG. 13 and depicting a cube being flipped on a horizontal axis.
Figure 15:
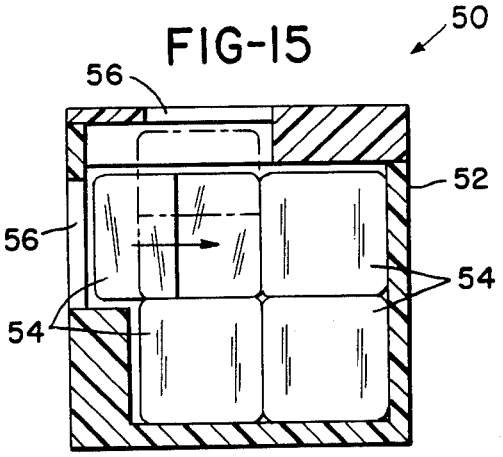
FIG. 15 is a vertical section comparable to FIG. 6 and depicting a cube being flipped on a vertical axis in the puzzle depicted in FIG. 13.

A variation of the first species of the puzzle is depicted in FIGS. 13–15. FIG. 13 depicts a seven cube puzzle comparable to the puzzle depicted by the solid lines in FIG. 1. The principal distinction is that the cube being flipped does not come into contact with the lateral edge of an aperture.

Reference is made to FIG. 13 in which the puzzle 40 has a box structure 42 which is comparable to the box structure of FIG. 1 and contains cubes 44 which are comparable to the cubes depicted in FIG. 1. The top and front of the box structure 42 each have an aperture 46 comparable to aperture 16 and a barrier strip 48 comparable to the apertures and barrier strip depicted in FIG. 1.

There are three ways for making the box structure 42 to prevent the flipping cube from contacting a lateral side of an aperture: (1) the vertical dimension between the top of the lower tier of cubes and the inner surface of the barrier strip 48 may be increased to be greater than the diagonal dimension of a cube; (2) the lateral dimension of the aperture may be increased to a maximum of the lateral internal dimension of the box structure as depicted in FIG. 13; and, (3) the combination of (1) and (2) above.

FIG. 15 is comparable to FIG. 6 in depicting puzzles in which the barrier strip is made flush with the exterior faces of the top and front side of the box structure. Puzzle 50 has a box structure 52 which is comparable to the box structure 22 of FIG. 5 and contains cubes 54 which are also comparable to the cubes depicted in FIGS. 5 and 6. The top and front of box structure 52 each have an aperture 56 comparable to apertures 26 in FIGS. 5 and 6. In the same manner as described in regard to the puzzle 40 depicted in FIG. 13, puzzle 50 is configured and sized to prevent a cube being flipped from contacting a lateral side of aperture 56.

Figure 16:
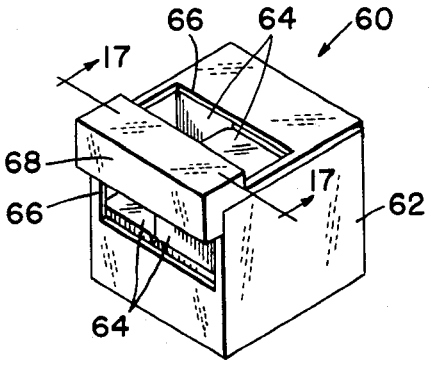
FIG. 16 is a perspective depicting a variation of the puzzle depicted in FIG. 7; and, FIG. 17 is a vertical section taken on line 17—17 of FIG. 16 and depicting the manner of engaging a cube to be flipped.
Figure 17:
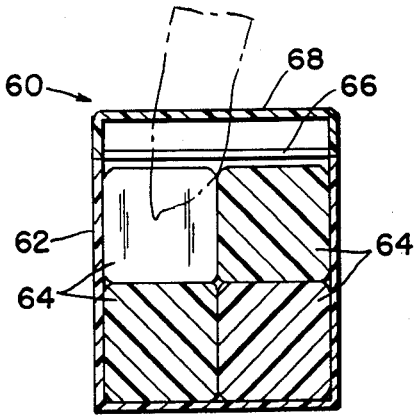

Reference is now made to FIG. 16 in which the puzzle 60 has a box structure 62 which is comparable to the box structure 32 of FIG. 7 and contains cubes 64 which are also comparable to the cubes of FIG. 7. The puzzle 60 is also provided with apertures 66 which are comparable with the apertures 36 in FIG. 7 and with an alcove 68 which is comparable to the alcove 38 in FIG. 7.

In the same manner as described in regard to the puzzle 40 depicted in FIG. 13, puzzle 60 is configured and sized to prevent a cube being flipped from contacting a lateral side of aperture 66.

The two broad species of the present flip cube puzzle may be configured and sized to permit the cube being flipped to engage a lateral side of an aperture during its rotation; or, as an alternative, each species may be configured and sized to prevent the cube from engaging the side of an aperture. Regardless of which alternative is selected, a cube may be flipped about either a vertical or a horizontal axis without changing the attitude of the puzzle. The attitude of the puzzles need be changed only when sliding a cube into an adjacent vacant space, as for example, when sliding a cube from one tier into an adjacent tier.

It is to be understood that the embodiments of the present invention as shown and described is to be regarded merely as illustrative, and that the invention is susceptible to variations, modifications and changes, without regard to construction methods, within the scope of the appended claims.

I claim:

1. A flip cube puzzle manipulatable by a player, said cube puzzle comprising: a box structure of parallelepipedon form including a top side, a front side, two lateral sides, and having a hollow rectangular interior housing in slidable relationship a predetermined number of uniformly sized cubes in at least one tier, the number of cubes being at least one less than the housing capacity of said rectangular interior, the vertical and horizontal dimensions of said rectangular interior being sufficient to permit rotation of one of the cubes in the vertical and horizontal tiers immediately adjacent to the top, front, and one lateral side of said box structure from one face to an adjacent face thereon, the top and front side of said box structure each having an aperture in register with each other and being wider than one of said cubes and laterally positioned to expose a portion of the cube to be rotated and a portion of an adjacent vacant space thereto for entry of a finger tip of said player through either of said apertures for purpose of plucking and flipping the cube to be rotated from one face to an adjacent face thereon with the flipped cube remaining in its original position in the rectangular interior of said box structure.

2. A flip cube puzzle manipulatable by a player, said cube puzzle comprising: a box structure of parallelepipedon form including a top side, a front side, two lateral sides, and having a hollow rectangular interior housing in slidable relationship a predetermined number of uniformly sized cubes in at least one tier, the number of cubes being at least one less than the housing capacity of said rectangular interior, the vertical and horizontal dimensions of said rectangular interior being sufficient to permit rotation of one of the cubes in the vertical and horizontal tiers immediately adjacent to the top, front, and one lateral side of said box structure from one face to an adjacent face thereon, the top and front side of said box structure each having an aperture in register with each other and being wider than one of said cubes and laterally positioned to expose a portion of the cube to be rotated and a portion of an adjacent vacant space thereto for entry of a finger tip of said player through either of said apertures for purpose of plucking and flipping the cube to be rotated from one face to an adjacent face thereon, with a lateral edge on one of said apertures coming in contact with a face of said rotating cube to provide a pivot edge for the final flipping of said rotating cube, with the flipped cube remaining in its original position in the rectangular interior of said box structure.

3. A flip cube puzzle manipulatable by a player, said cube puzzle comprising: a box structure of parallelepipedon form including a top side, a front side, two lateral sides, and having a hollow rectangular interior housing in slidable relationship a predetermined number of uniformly sized cubes in two horizontal tiers, the number of cubes being at least one less than the housing capacity of said rectangular interior, the vertical and horizontal dimensions of said rectangular interior being sufficient to permit rotation of one of said cubes in the top tier immediately adjacent to the top, front, and one lateral side of said box structure from one face to an adjacent face thereon, the top and front side of said box structure each having an aperture in register with each other and being wider than one of said cubes and laterally positioned to expose a portion of the cube to be rotated and a portion of an adjacent vacant space thereto for entry of a finger tip of said player through either of said apertures for purpose of plucking and flipping the cube to be rotated from one face to an adjacent face thereon with the flipped cube remaining in its original position in the rectangular interior of said box structure.

4. A flip cube puzzle in accordance with claim 3 in which the number of said cubes is seven, and the rectangular interior of said box structure has a capacity for four cubes in each of said tiers.

5. A flip cube puzzle manipulatable by a player, said cube puzzle comprising: a box structure of parallelepipedon form including a top side, a front side, two lateral sides, and having a hollow rectangular interior housing in slidable relationship a predetermined number of uniformly sized cubes in two horizontal tiers, the number of cubes being at least one less than the housing capacity of said rectangular interior, the vertical and horizontal dimensions of said rectangular interior being sufficient to permit rotation of one of the cubes in the top tier immediately adjacent to the top, front, and one lateral side of said box structure from one face to an adjacent face thereon, the top and front side of said box structure each having an aperture in register with each other and being wider than one of said cubes and laterally positioned to expose a portion of the cube to be rotated and a portion of an adjacent vacant space thereto for entry of a finger tip of said player through either or said apertures for purpose of plucking and flipping the cube to be rotated from one face to an adjacent face thereon, with a lateral edge on one of said apertures coming in contact with a face of said rotating cube to provide a pivot edge for the final flipping of said rotating cube, with the flipped cube remaining in its original position in the rectangular interior of said box structure.

6. A flip cube puzzle manipulatable by a player, said cube puzzle comprising: a box structure of parallelepipedon form including a top side, a front side, two lateral sides, and having a hollow rectangular interior housing in slidable relationship seven uniformly sized cubes in two horizontal tiers with the rectangular interior of said box structure having a capacity for four cubes in each of said tiers, the vertical and horizontal dimensions of said rectangular interior being sufficient to permit rotation of one of said cubes in the top tier immediately adjacent to the top, front, and one lateral side of said box structure from one face to an adjacent face thereon, the top and front side of said box structure each having an aperture in register with each other and positioned for entry of a finger tip of said player into a vacant space adjacent to the cube to be rotated for purpose of plucking and flipping the cube to be rotated from one face to an adjacent face thereon, said rotating cube coming into contact with a lateral side of one of said apertures to form a pivot edge for the final flipping of said rotating cube, with the flipped cube remaining in its original position in the rectangular interior of said box structure.

7. A flip cube puzzle manipulatable by a player, said cube puzzle comprising: a box structure of parallelepipedon form including a top side, a front side, two lateral sides, and having a hollow rectangular interior, the top and front side of said box structure each having an aperture therethrough in register with each other and in open communication at the edge of said box structure formed by said top and said front side thereof and adjacent to at least one upper front corner of said box structure, the rectangular interior of said box structure housing in slidable relationship a predetermined number of uniformly sized cubes in at least one horizontal tier, the number of cubes being at least one less than the space capacity for cubes in the rectangular interior of said box structure, said box structure further having an alcove at the edge of said box structure formed by the top and front side thereof, said alcove being in open communication with each of said apertures and extending outwardly from the top and front side of said box structure a sufficient distance to permit rotational flipping of one of said cubes when occupying a space at one of the upper front corners of the rectangular interior of said box structure adjacent to said apertures, said apertures being of sufficient width to form openings for entry of a finger tip of said player through one of said apertures into a vacant space adjacent to the cube to be flipped, said player applying pressure to a portion of the cube to be flipped to thereby cause said cube to flip from its original attitude to an adjacent side thereon while remaining in its original space within said box structure.

8. A flip cube puzzle in accordance with claim 7 in which a lateral edge on one of said apertures comes in contact with a face of said rotating cube to provide a pivot edge for the final flipping of said rotating cube.

9. A flip cube puzzle manipulatable by a player, said cube puzzle comprising: a box structure of parallelepipedon form including a top side, a front side, two lateral sides, and having a hollow rectangular interior, the top and front side of said box structure each having an aperture therethrough in register with each other and in open communication at the edge of said box structure formed by said top and said front side thereof and adjacent to at least one upper front corner of said box structure, the rectangular interior of said box structure housing in slidable relationship a predetermined number of uniformly sized cubes in two horizontal tiers, the number of cubes being at least one less than the space capacity for cubes in the rectangular interior of said box structure, said box structure further having an alcove at the edge of said box structure formed by the top and front side thereof, said alcove being in open communication with each of said apertures and extending outwardly from the top and front side of said box structure a sufficient distance to permit rotational flipping of one of said cubes when occupying a space at one of the upper front corners of the rectangular interior of said box structure adjacent to said apertures, said apertures being of sufficient width to form openings for entry of a finger tip of said player through one of said apertures into a vacant space adjacent to the cube to be flipped, said player applying pressure to a portion of the cube to be flipped to thereby cause said cube to flip from its original attitude to an adjacent side thereof while remaining in its original space within said box structure.

10. A flip cube puzzle in accordance with claim 9 in which the number of cubes is seven, and the rectangular interior of said box structure has a capacity for four cubes in each of said tiers.

11. A flip cube puzzle in accordance with claim 9 in which a lateral edge on one of said apertures comes in contact with a face of said rotating cube to provide a pivot edge for the final flipping of said cube.

12. A flip cube puzzle manipulatable by a player, said cube puzzle comprising: a box structure of parallelepipedon form including a top side, a front side, two lateral sides, and having a hollow rectangular interior, the top and front side of said box structure each having an aperture therethrough in register with each other and in open communication at the edge of said box structure formed by said top and said front side thereof and adjacent to at least one upper front corner of said box structure, the rectangular interior of said box structure housing in slidable relationship seven uniformly sized cubes in two horizontal tiers with the rectangular interior of said box structure having a capacity for four cubes in each of said tiers, said box structure further having an alcove at the edge of said box structure formed by the top and front side thereof, said alcove being in open communication with each of said apertures and extending outwardly from the top and front side of said box structure a sufficient distance to permit rotational flipping of one of said cubes when occupying a space at one of the upper front corners of the rectangular interior of said box structure adjacent to said apertures, said apertures being of sufficient width to form openings for entry of a finger tip of said player through one of said apertures into a vacant space adjacent to the cube to be flipped, said player applying pressure to a portion of the cube to be flipped to thereby cause said cube to rotate and come into contact with a lateral side of one of said apertures to form a pivot edge for the final flipping of said rotating cube, the rotating cube being flipped from its original attitude to an adjacent side thereon while remaining in its original space within said box structure.

* * * * *